US007451734B2

(12) United States Patent
Weber

(10) Patent No.: US 7,451,734 B2
(45) Date of Patent: Nov. 18, 2008

(54) V-ENGINE WITH ROTATABLE CYLINDER HEADS

(75) Inventor: Christian Weber, Markdof (DE)

(73) Assignee: Weber Technology AG, Kusnacht (CH)

( * ) Notice: Subject to any disclaimer, the term of this patent is extended or adjusted under 35 U.S.C. 154(b) by 10 days.

(21) Appl. No.: 11/716,663

(22) Filed: Mar. 12, 2007

(65) Prior Publication Data

US 2007/0215076 A1 Sep. 20, 2007

(30) Foreign Application Priority Data

Mar. 17, 2006 (DE) ..... 10 2006 013 940

(51) Int. Cl.
*F02B 75/22* (2006.01)
*F02F 1/42* (2006.01)

(52) U.S. Cl. ..... 123/193.5; 123/54.4

(58) Field of Classification Search ..... 123/54.4, 123/54.5, 54.6, 54.7, 54.8, 193.3, 193.5
See application file for complete search history.

(56) References Cited

U.S. PATENT DOCUMENTS 4,633,826 A 1/1987 Tominaga et al.
4,787,342 A * 11/1988 Matsumori et al. ..... 123/54.6

FOREIGN PATENT DOCUMENTS

DE 2 041 964 5/1971
DE 39 16512 5/1990
DE 201 06 890 6/2001

* cited by examiner

*Primary Examiner*—Noah Kamen
(74) *Attorney, Agent, or Firm*—Shlesinger, Arkwright & Garvey LLP

(57) ABSTRACT

A V-engine (10) having two banks of cylinders (30) each comprising at least one cylinder (20) and a cylinder head (40) is envisaged, wherein the banks of cylinders (30) each comprise at least one inlet valve (12) and also at least one outlet valve (14) for each cylinder (20), while the at least one inlet valve (12) and the at least one outlet valve (14) are arranged in pairs opposite one another on opposite sides of the cylinder head (10), and each cylinder head (10) and its connections to the other engine components are constructed such that it can be mounted in a first position relative to the respective bank of cylinders (30) and in a position rotated through 180° relative to the first position on the same bank of cylinders (30).

10 Claims, 2 Drawing Sheets

V-ENGINE WITH ROTATABLE CYLINDER HEADS

BACKGROUND OF THE INVENTION

The present invention relates to a V-engine with rotatable cylinder heads.

V-engines are generally known in the art. They conventionally have two banks of cylinders each comprising the same number of cylinders. The cylinders are arranged in pairs substantially opposite one another. Thus, a V-engine has in all two or four or six cylinders. However, engines that have more than six cylinders are also known.

The cylinders of the two banks of cylinders are tilted at an angle to one another. This angle is known as the V-angle. On their underside the cylinders are connected to the crankshaft via connecting rods. The V widens out further in the upward direction, so that finally there is enough space to arrange the cylinder heads on the corresponding banks of cylinders.

The inlet valves and the outlet valves and the camshafts that actuate the valves are housed in the cylinder heads. The supply of fuel and the removal of exhaust gas from the cylinders are controlled by the inlet valves and outlet valves. The valves are actuated by the camshaft. The camshaft is driven by the crankshaft by means of a power-transmitting endless element, conventionally a chain or a belt.

As a rule, one inlet valve and one outlet valve are provided for each cylinder. However, it is also known to provide more than one inlet valve and one outlet valve. Either the inlet valves and the outlet valves of one bank of cylinders may be controlled jointly by one camshaft, or two camshafts may be provided, one of which controls the inlet valves while the other controls the outlet valves.

Depending on the dimensions of the cylinders and cylinder heads, the V-angle is limited in the downward direction but may be up to 180°.

In order to make the engine as small as possible in construction, the V-angle is frequently selected so that components of the engine can be arranged inside the V. As it has proved advantageous when arranging the inlet valves and outlet valves to place the valves opposite one another on opposite sides of the cylinder head, so that there is a crossflow of fresh and exhaust gas inside the combustion chamber of the cylinder, the air/fuel supply system is nowadays often arranged inside the V. The exhaust gas system is then arranged accordingly on the outer sides of the banks of cylinders.

In some cases it may also be advantageous to arrange the exhaust gas system inside the V and to arrange the air/fuel supply system on the outside of the cylinder heads. This arrangement can significantly improve the efficiency of V-engines particularly with respect to the efficient use of turbochargers.

A special cylinder head may be provided for each bank of cylinders. This means that there is one cylinder head for the "right-hand" bank of cylinders and one cylinder head for the "left-hand" bank of cylinders. This type of construction has the advantage that when designing the connections and attachments of the cylinder heads to the other engine components, there is no need to be concerned with maintaining a symmetrical arrangement etc. One disadvantage, however, is the fact that the two cylinder heads have different components, which increases the production costs.

In order to achieve greater economy in V-engine production, V-engines have been developed which are symmetrically constructed such that the cylinder heads are identical, i.e. the cylinder heads are identical components. In this way, errors during assembly are prevented and the production costs of the engine are reduced.

As already mentioned, in V-engines of the prior art, the exhaust gas system is generally guided outwards and the air/fuel supply system is generally guided within the V. Under certain circumstances it may also be advantageous to guide the exhaust gas system inside the V and the fuel supply system outside. The V-engines according to the prior art cannot, however, be used for both types of arrangement. The engines are designed only for one or other type of arrangement. If a different one is wanted, a new construction is required, which incurs considerable costs.

SUMMARY OF THE INVENTION

By contrast, the invention proposes a V-engine with two banks of cylinders, each of which comprises at least one cylinder and a cylinder head, wherein the banks of cylinders each comprise at least one inlet valve and also at least one outlet valve for each cylinder, while the at least one inlet valve and the at least one outlet valve are arranged in pairs opposite one another on opposite sides of the cylinder head, and each cylinder head and its connections to the other engine components are constructed such that it can be mounted in a first position relative to the respective bank of cylinders and in a position rotated through 180° relative to the first position.

As a result, the cylinder head can be arranged in a flipped over position, i.e. rotated through 180°. Thus it is possible to choose freely whether the inlet valves are to be located inside the V formed by the cylinders or whether they should be directed outwards. In this way the position of the air/fuel supply system and the exhaust gas system is determined. Admittedly, the fuel supply system and the exhaust gas system still have to be individually constructed, depending on whether they are mounted inside the V or on the outside of the cylinder heads, but the other engine components, including the cylinder heads, remain identical. This provides a V-engine which is particularly flexible in construction.

In one embodiment each cylinder head and its connections to the other engine components can, moreover, be constructed so that the two cylinder heads are identical components.

In this way, the cylinder heads are not only able to rotate on the banks of cylinders but can also be arranged in a flipped over position relative to the central axis of the engine.

In one embodiment of the invention each bank of cylinders has an even number of cylinders.

According to the invention each cylinder head has at least one camshaft which is driven by means of a power-transmitting endless element which is connected to the corresponding camshaft between the central cylinders of the corresponding bank of cylinders.

One problem with the construction of a cylinder head according to the invention may be the arrangement of the power-transmitting endless elements that connect the crankshaft and the camshafts. The power-transmitting endless elements are usually chains or belts. In order that the cylinder head can be arranged in a flipped over position not only to the central plane of the V-engine but also on each individual bank of cylinders, the power-transmitting endless element that drives the camshaft is arranged between the central cylinders of a bank of cylinders. The resulting symmetry of the cylinder head makes it possible for the cylinder head to be positioned flexibly.

Preferably, each cylinder head has one camshaft. However, it is also possible to provide two camshafts for each cylinder head.

According to the invention one inlet valve and one outlet valve are provided for each cylinder. However, it is also possible for two inlet valves and two outlet valves to be provided for each cylinder.

Preferably, each bank of cylinders has two cylinders. This produces a V4 engine.

As already described, in one embodiment of the invention the exhaust gas system may be arranged inside the V formed by the cylinders.

Moreover, in one embodiment of the invention, the fuel supply system may be arranged inside the V formed by the cylinders.

The V-engine according to the invention may be constructed as an outboard motor for marine or aquatic vehicles.

Further advantages and embodiments of the invention will become apparent from the description and the accompanying drawings. It will be understood that the features mentioned above and those to be described hereinafter can be used not only in the particular combination stated but also in other combinations or on their own without departing from the scope of the present invention.

BRIEF DESCRIPTION OF THE DRAWINGS

The invention is schematically illustrated in the drawings by reference to an exemplifying embodiment and is described in more detail hereinafter with reference to the drawings.

DESCRIPTION OF THE PREFERRED EMBODIMENT

Figure 1:
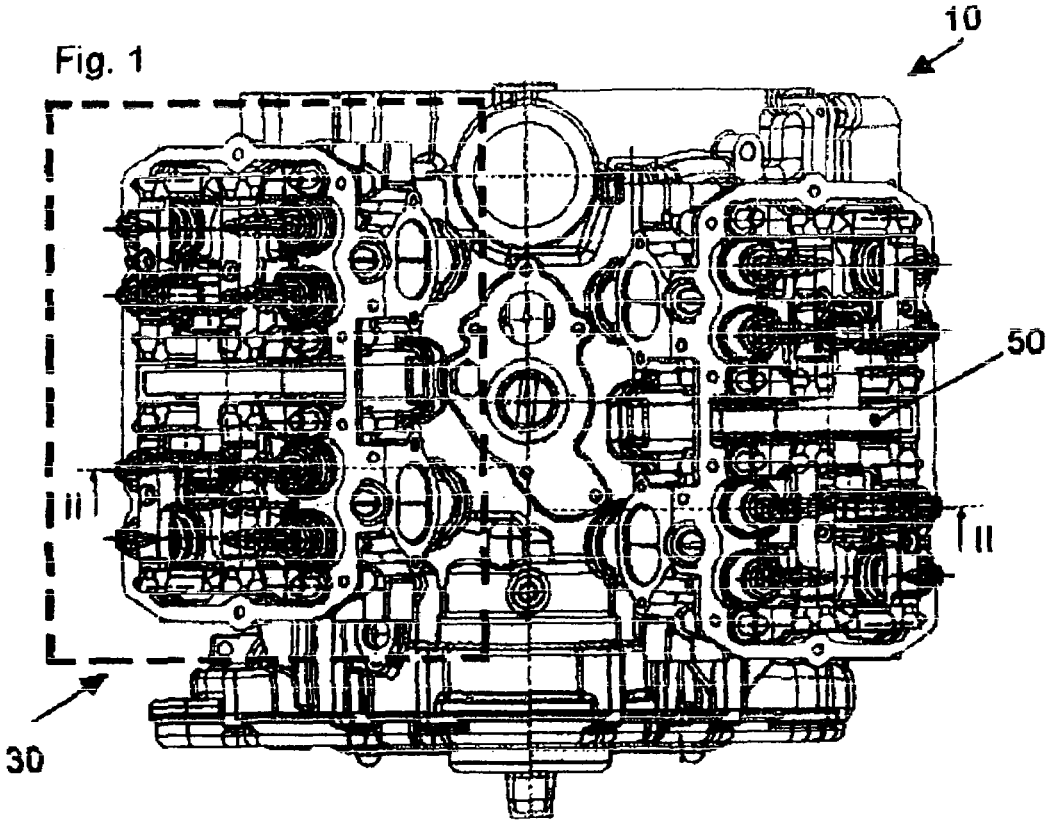
FIG. 1 shows a V-engine according to the invention wherein the cylinder heads are arranged in a first position.

FIG. 1 shows a V-engine 10 according to the invention, wherein the cylinder heads 40 are arranged in a first position. The V-engine 10 has two banks of cylinders 30 each comprising two cylinders 20.

Figure 2:
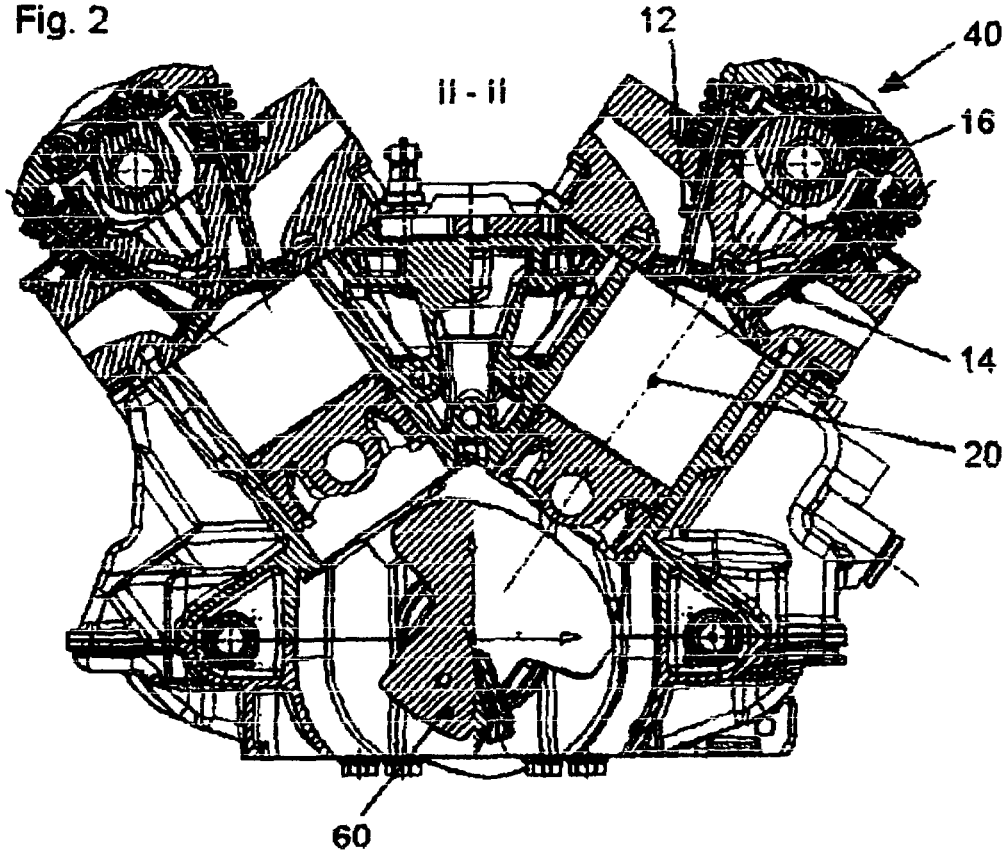
FIG. 2 shows a cross-sectional view on the line II-II in FIG. 1.

FIG. 2 shows a cross-sectional view of the V-engine 10 according to the invention on the line II-II in FIG. 1.

The cylinders 20 are each connected to the crankshaft 60 via connecting rods (not shown). Each bank of cylinders 30 has a cylinder head 40. In this cylinder head 40 are provided two inlet valves 12 and two outlet valves 14 for each cylinder 20. The valves 12, 14 are controlled by means of a camshaft 16.

The camshaft 16 is connected to the crankshaft 60 by means of a power-transmitting endless element 50, according to the invention. The power-transmitting endless element 50 is preferably a chain or a belt. As can be seen from FIG. 1, the power-transmitting endless element 50 is arranged in each case between the central cylinders 20 of the banks of cylinders 30.

As the engine shown here is a V4 engine, the power-transmitting endless element 50 is thus arranged between the two cylinders 20 of a bank of cylinders 30.

As can be seen from FIG. 2, the supply lines to the inlet valves 12 are directed towards the interior of the V formed by the cylinders 20. Accordingly, the supply lines to the outlet valves 14 are directed outwards.

Figure 3:
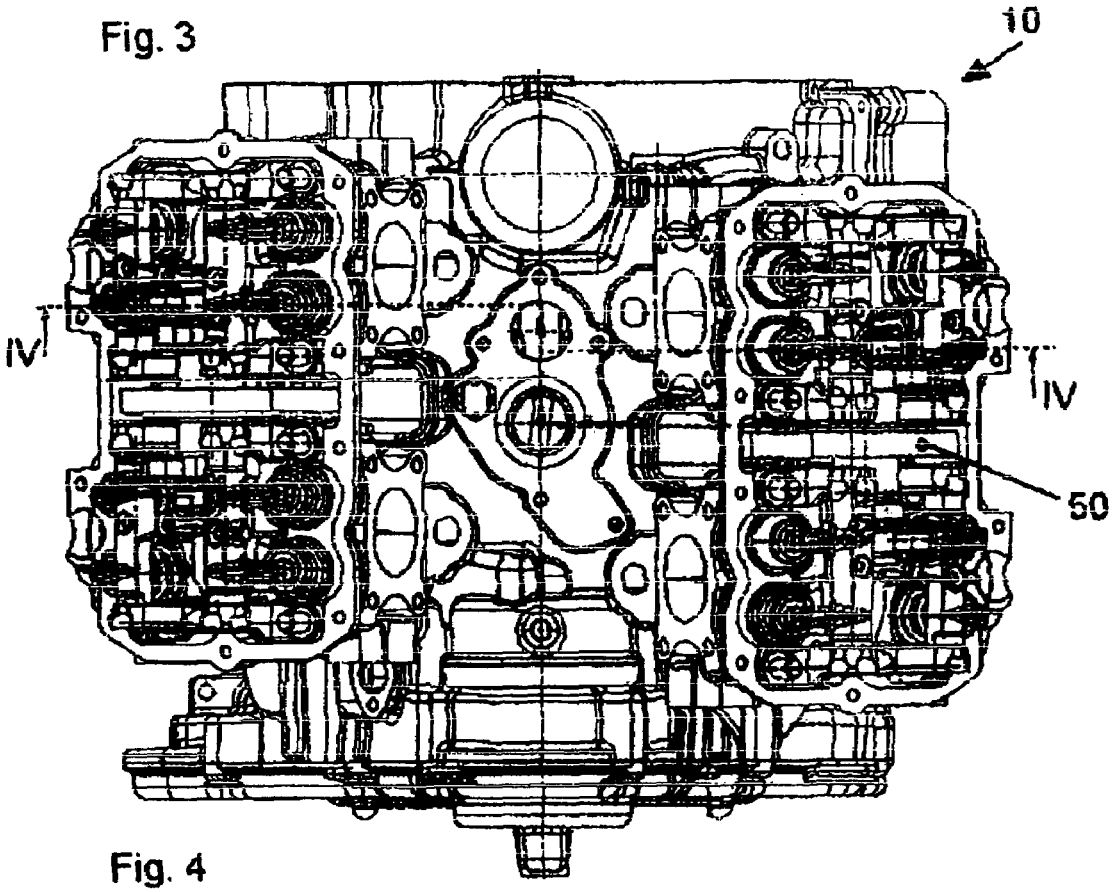
FIG. 3 shows a V-engine according to the invention wherein the cylinder heads are arranged in a second position.

FIG. 3 shows the V-engine 10 according to the invention, wherein the cylinder heads 40 are arranged in a second position rotated through 180° relative to the first position.

Figure 4:
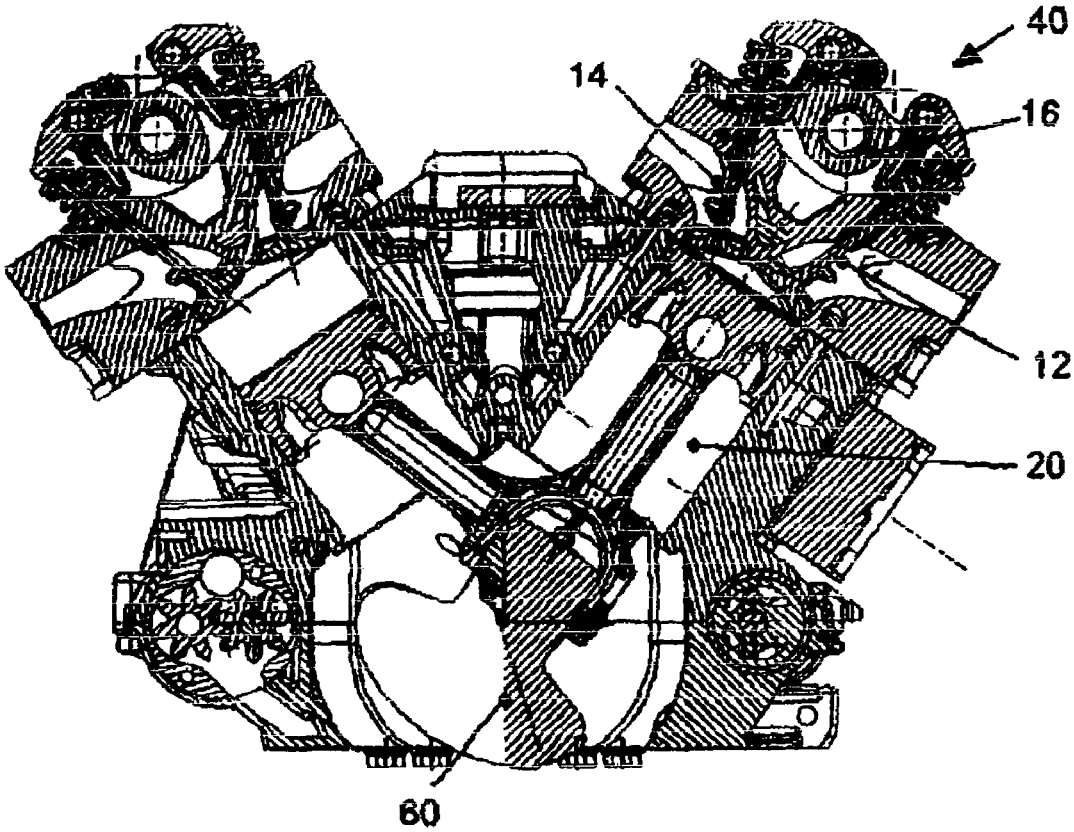
FIG. 4 shows a cross-sectional view on the line IV-IV in FIG. 3.

FIG. 4 shows a sectional view of the V-engine 10 of FIG. 3 along a line IV-IV.

As can be seen from FIG. 4, the supply lines to the inlet channels 12 are directed outwards. The supply lines to the outlet valves 14, on the other hand, are directed towards the interior of the V formed by the cylinders 20. The components shown in FIGS. 3 and 4 are identical to the components shown in FIGS. 1 and 2. Although the cylinder heads 40 can be positioned by being rotated through 180°, i.e. flipped into a reverse position, they can still be attached to the other engine components and are fully operational.

In contrast to the first position shown in FIGS. 1 and 2, in this second position the exhaust gas system can be arranged in the interior of the V formed by the cylinders 20 and the fuel supply system can be arranged on the outside.

Only the air/fuel supply system, the exhaust gas system and any turbocharger provided have to be redesigned. The other engine components and particularly the cylinder heads 40, however, are identical to those in FIGS. 1 and 2.

Whereas the position shown in FIGS. 1 and 2 and the corresponding arrangement of the exhaust gas system and the fuel supply system are particularly suitable for land vehicles, the arrangement shown in FIGS. 3 and 4 is particularly suitable for marine craft, as the arrangement of the exhaust gas system inside the V formed by the cylinders 20 makes it possible to achieve particularly efficient utilisation of the exhaust gas turbochargers with a small capacity construction and thus a good specific weight of the V-engine 10.

As a result, the V-engine 10 according to the invention can be manufactured for different applications among a range of economically viable multiple uses. In particular, the ability to position the cylinder heads 40 flexibly constitutes a major advantage over the prior art.

The invention claimed is:

1. V-engine having two banks of cylinders each comprising at least one cylinder and a cylinder head, wherein the banks of cylinders each comprise at least one inlet valve and also at least one outlet valve for each cylinder, while the at least one inlet valve and the at least one outlet valve are arranged in pairs opposite one another on opposite sides of the cylinder head, and each cylinder head and its connections to the other engine components are constructed such that it can be mounted in a first position relative to the respective bank of cylinders and in a position rotated through 180° relative to the first position on the same bank of cylinders.

2. V-engine according to claim 1, wherein each cylinder head and its connections to the other engine components are further constructed so that the two cylinder heads are identical.

3. V-engine according to claim 1 wherein each bank of cylinders comprises an even number of cylinders.

4. V-engine according to claim 3, wherein each cylinder head has at least one camshaft which is driven by means of a power-transmitting endless element which is connected to the corresponding camshaft between the central cylinders of the corresponding bank of cylinders.

5. V-engine according to claim 4, wherein each cylinder head comprises a camshaft.

6. V-engine according to claim 1 wherein two inlet valves and two outlet valves (14) are provided for each of cylinder.

7. V-engine according to claim 1 wherein the banks of cylinders each have two cylinders.

8. V-engine according to claim 1 wherein an exhaust gas system is attached inside the V formed by the cylinders.

9. V-engine according to claim 1 wherein an air/fuel supply system is arranged inside the V formed by the cylinders.

10. V-engine according to claim 1 which is designed as an outboard motor for marine craft.

* * * * *